United States Patent [19]

Schnurbus et al.

[11] 4,274,888

[45] Jun. 23, 1981

[54] MAGNETIC CORES

[75] Inventors: Heinrich Schnurbus; Horst Nelle; Wilhelm Wolf, all of Essen, Fed. Rep. of Germany

[73] Assignee: Fried. Krupp Gesellschaft mit beschränkter Haftung, Essen, Fed. Rep. of Germany

[21] Appl. No.: 946,417

[22] Filed: Sep. 27, 1978

[30] Foreign Application Priority Data

Oct. 1, 1977 [DE] Fed. Rep. of Germany 2744333

[51] Int. Cl.[3] ..... C21D 1/04

[52] U.S. Cl. ..... 148/108; 148/31.55

[58] Field of Search ..... 148/31.55, 31.57, 103, 148/108

[56] References Cited

U.S. PATENT DOCUMENTS

| | | | |
|---|---|---|---|
| 1,807,021 | 5/1931 | Yensen | 148/31.57 |
| 2,002,689 | 5/1935 | Bozorth et al. | 148/108 |
| 2,499,860 | 3/1950 | Hansen | 148/103 |
| 2,558,104 | 6/1951 | Scharschu | 148/31.57 |
| 2,569,468 | 10/1951 | Gaugler | 148/108 |
| 3,440,364 | 4/1969 | Parker | 148/103 |
| 3,844,849 | 10/1974 | Kuroda | 148/108 |
| 3,989,555 | 11/1976 | Yamagishi | 148/31.57 |

FOREIGN PATENT DOCUMENTS

| | | |
|---|---|---|
| 1259367 | 1/1968 | Fed. Rep. of Germany . |
| 1558818 | 10/1975 | Fed. Rep. of Germany . |
| 638210 | 7/1950 | United Kingdom . |
| 866429 | 4/1961 | United Kingdom . |
| 945066 | 12/1963 | United Kingdom . |
| 1160788 | 8/1969 | United Kingdom . |
| 1168761 | 10/1969 | United Kingdom . |

OTHER PUBLICATIONS

Brochure M031–Vacuumschmelze GmbH.

Volk, *Nickel and Nickel Alloys, Properties and Behavior,* 1970, 5.324, "Alloys with Rectangular Loop or High Permeability due to Magnetic Field Tempering", pp. 93–98.

*Metallwissenschaft und Technik,* vol. 16, pp. 1185–1192.

Blatt für Patent Muster–und Zëichenwesen, 1977, p. 36, sect. 33, paragraph (1) (2).

Jackson, Classical Electrodynamics, p. 620.

*Primary Examiner*—L. Dewayne Rutledge

*Assistant Examiner*—John P. Sheehan

*Attorney, Agent, or Firm*—Spencer & Kaye

[57] ABSTRACT

The invention herein disclosed is directed to novel magnetic cores, particularly magnetic tape-wound cores, and to a new, novel and less expensive method of manufacture. The alloys employed in the manufacture of these cores employ smaller quantities of expensive metals such as nickel and, accordingly, result in substantial savings. The cores are exceptionally useful because of their high available flux-density change and high pulse permeability. Generally, the alloys employed contain nickel contents of from about 49 to 56 percent by weight of the alloy, and the remainder is substantially iron and small quantities of additives. The magnetic core is heat treated in a hydrogen atmosphere for several hours, cooled to room temperature, then reheated above the Curie Point and then cooled in a transverse magnetic field. Alternatively, it is possible to cool to just above the Curie Point, and omit the room temperature cooling and subsequent reheating.

16 Claims, No Drawings

MAGNETIC CORES

BACKGROUND OF THE INVENTION

This invention pertains to the manufacture of magnetic cores, essentially magnetic tape-wound cores, comprising iron-nickel alloys, which cores are suitable for use with single polarity rectangular voltage pulses and have a high maximum available change of flux-density ΔB of more than 1 T and high pulse permeability. Cost effectiveness is achieved by novel production means and by employing smaller quantities of the more expensive alloy metals, such as nickel. The magnetic alloys may be rolled into thin tapes having a maximum thickness of 0.1 mm and which are shaped as the magnetic core.

In dealing with single polarity pulse transformers, the magnetic core is required to operate between positive residual flux density and positive saturation flux-density. A high available change of flux-density allows transmission of high power pulses. When, simultaneously, pulse permeability is high, it is possible to transmit rectangular voltage pulses without excessive shape distortion using only a few primary windings. In saturable reactors, a high available change of flux-density permits the use of small core cross-sections and a fewer number of windings. This makes possible the necessary current limitation required for some semiconductor devices during switching to on and off positions.

It is known that by heat treatment and magnetic field treatment of iron-nickel alloys containing more than 50% nickel, it is possible to achieve initial permeabilities of more than 50,000. However, as the result of high residual flux-density $B_R$ these alloys have a low available flux-density change ΔB in working with unipolar voltage pulses. It is also known, that it is possible to increase ΔB by means of an air gap in the magnetic circuit. However, this leads to a simultaneous reduction of the permeability.

Not until the disclosure of Dt-PS No. 15 58 818, herein incorporated by reference, did a material become available which has a high ΔB combined with a favorable initial permeability. In the process disclosed, there is employed an alloy containing nickel-iron-molybdenum in percentages of 61 to 60% nickel, 2 to 4% molybdenum, and the remainder being mainly iron and several deoxidation and processing additives. Tapes of 0.1 to 0.003 mm thickness are made from this alloy and wound as toroidal cores, then heat treated at temperatures from 950° to 1220° C. for 4 to 6 hours followed by a tempering treatment at 400° to 500° C. in a magnetic field axial to the core and transverse to the subsequent direction of the magnetic flux.

The foregoing process is economically disadvantageous since it requires a high nickel content of from 61 to 67 percent and a long tempering treatment of 3 to 5 hours at 400° to 500° C. in a magnetic field to produce the magnetic core.

SUMMARY OF THE INVENTION

It is the main purpose of this invention to produce magnetic cores comprising magnetic alloys at a reduced cost, which cores are extremely useful due to their high available flux-density change and their high pulse-permeability.

Upon further study of the specification and appended claims, further objects and advantages of this invention will become apparent to those skilled in the art.

In accordance with the present invention, there is provided a magnetic core having an available flux-density change ΔB of more than 1 T and concurrently high pulse permeability for use with single polarity rectangular voltage pulses. The magnetic core consists essentially of an iron-nickel alloy containing 49 to 56 weight percent nickel and balance essentially iron. The alloy is melted, shaped and then rolled into a thin tape of maximum 0.1 mm thickness, which is wound to form the magnetic core. The core is treated in a hydrogen atmosphere at a temperature exceeding 1000° C. for a period lasting from 3 to 6 hours, then cooled to room temperature, subsequently reheated to above Curie-Point temperature, and then cooled in a magnetic field transverse to the direction of the magnetic flux later obtained.

The hydrogen heat treatment and the subsequent treatments can be performed only after the tape is configured to the shape of the magnetic core.

It is also possible, after the high temperature hydrogen heat treatment above 1000° C., to cool immediately to a temperature above the Curie Point and then continue with the aforedescribed magnetic field treatment. The result is the elimination of two steps, namely cooling down from higher than 1000° C. to room temperature, and then reheating. In either case, the temperature above the Curie Point at which the magnetic field treatment begins preferably is 650° to 750° C.

The alloy can contain processing and deoxidation additives such as silicon and manganese and can contain up to 4% by weight of molybdenum, such as about 1% molybdenum.

It is preferred to generate the magnetic field by means of a coil with a current flowing therethrough. It is possible to carry out the magnetic field treatment in such a coil outside the furnace. This technique permits greater variations in the cooling down rate (dT/dt). by the proper choice of a cooling down technique, the magnetic characteristics of the alloy may be enhanced.

DETAILED DISCUSSION

The starting alloy consists essentially of, in % by weight:

| | General | Preferred |
|---|---|---|
| Ni | 49–56 | 53–55 |
| Mo | 0–4 | 0–2 |
| Mn | 0–0.6 | 0.2–0.4 |
| Si | 0–0.4 | 0.1–0.3 |
| Fe | remainder | remainder |

The molten alloy is conventionally shaped into thin tapes having a maximum thickness of 0.1 mm, preferably a thickness in the range of 0.05–0.1 mm.

Tape wound cores are then treated in a hydrogen atmosphere at above 1000° C. preferably at 1100°–1220° C. for 3 to 6 hours, preferably 5–6 hours.

After the high temperature heat treatment step, the cores are cooled down by one of two techniques:

(A) The cores are cooled to room temperature. In this case, the general and preferred rates of cooling are 1° to 50° C./min. and 2° to 10° C./min. respectively.

(B) The cores are cooled to a temperature just above the Curie Point, especially to a temperature range of 0° to 200° C., in particular to 100° to 200° C. above the Curie Point. Generally, the Curie Point temperatures for the alloys of this invention are in the range of 500° to 550° C. The general and preferred rates of cooling in this step are 1° to 50° C./min. and 2° to 10° C./min. respectively.

When cooling step (A) is employed, it is necessary to reheat the cores to a temperature just above the Curie Point, preferably to 650°–750° C., or more particularly to the temperatures designated in cooling step (B) above. The general and preferred rates of reheating are 1° to 50° C./min. and 2° to 10° C./min., respectively.

The next step, whether it be applied to the cores reheated as in (A), or merely cooled as in (B), comprises placing the cores in a magnetic field, the direction of which corresponds to the axis of the cores, and cooling down. The cooling down generally is to 200° C., preferably to room temperature. The rate of cooling down durng this step is very important for obtaining the optimum desired properties for the core, general and preferred rate of cooling being 10° to 100° C./min. and 50° to 100° C./min., respectively.

The magnetic field is generated by a current-carrying coil preferably outside the furnace. Its strength should exceed 500 A/cm to overcome the demagnetizing field of the magnetized cores.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperature are set forth uncorrected in degrees Celsius; unless otherwise indicated, all parts and percentages are by weight.

EXAMPLES

The invention is more specifically set forth by reference to the magnetic cores whose chemical composition in terms of percents by weight is given in Table 1, below. These materials, while molten, are poured into blocks, hot forged and hot rolled to a thickness of about 4 mm. By subsequent cold rolling with intermediate heat treatment, tapes of thicknesses 0.03, 0.05 and 0.1 mm were produced. These tapes were wound into cores having an outside diameter of about 20 mm and an inside diameter of 10 mm with a height of 6 mm. After heat treating for six hours at 1200° C. in a hydrogen atmosphere, followed by cooling to room temperature, the tape-wound cores were heat tempered at 650° C. for 0.5 hours in hydrogen atmosphere, and then cooled in a magnetic field at various cool down rates. The lines of the magnetic field run in an axial direction to the tape-wound cores. Table 2, below, illustrates the properties of these products.

TABLE 1

| | Ni | Mo | Mn | Si | Fe |
|---|---|---|---|---|---|
| A | 54.35 | <0.01 | 0.36 | 0.16 | Remainder |
| B | 54.50 | <0.01 | 0.40 | 0.13 | Remainder |
| C | 54.85 | 1.05 | 0.36 | 0.13 | Remainder |

TABLE 2

| Example | Alloy | Tape Thickness (mm) | Cooling-Down in a transverse Magnetic Field | Cooling-Down Speed (°C./min.) | Maximum available flux-density change ΔB (T) | Permeability $\mu_4$ |
|---|---|---|---|---|---|---|
| 1 | A | 0.05 | no | 50 | 0.50 | 11160 |
| 2 | A | 0.03 | yes | 50 | 1.41 | 1730 |
| 3 | A | 0.05 | yes | 50 | 1.43 | 2210 |
| 4 | A | 0.10 | yes | 50 | 1.44 | 2740 |
| 5 | A | 0.05 | yes | 100 | 1.38 | 3580 |
| 6 | A | 0.05 | yes | 15 | 1.43 | 2230 |
| 7 | C | 0.05 | yes | 50 | 1.39 | 2170 |
| 8 | B | 0.05 | yes | 50 | 1.43 | 2370 |

The magnetic core characteristics shown in Table 2 are in terms of maximum available flux-density change ΔB and permeability $\mu_4$. ΔB is the difference between the flux-density at a high saturating field of $H=12.5$ amperes/cm and the residual flux-density $B_R$ obtained by quasistatic measurment. The permeability $\mu_4$ is determined at a frequency of 50 hertz and a magnetic field amplitude of 4 mA/cm, while the pulse permeability $\mu_I$ is measured in a sequence of unipolar rectangular voltage pulses. The frequency of the pulses was selected low enough so that at the start of a new pulse, the core possesses the residual flux-density. The change of flux-density is obtained by integrating the voltage pulse, $\int U dt$. The change of the magnetic field strength ΔH is calculated from the magnetization current. This yields the pulse permeability $\mu_I$, derived from the following formula:

$$\mu_I = \frac{\Delta B}{\mu_O \Delta H},$$

$$\text{where } \mu_o = 4\pi \cdot 10^{-7} \frac{Vs}{Am}.$$

The data of Table 2, is conclusive evidence of the influence of cooling the cores in a transverse magnetic field. This step appears very effective in establishing the magnitude of the maximum available flux-density change ΔB. When cooling is effected without a magnetic field, the maximum available ΔB is notably less than when cooling occurs in a magnetic field. Comparison of examples 2 and 8 clearly shows that it is also possible to provide high maximum available ΔB in magnetic cores made of thin tapes.

When the tape wound cores made in accordance with the process of Dt-PS No. 15 58 818 are compared to those of the invention, it is shown that when magnetic cores not having molybdenum, and a smaller nickel content, are treated as set forth above, higher maximum available ΔB coupled with desirable pulse permeability are obtained. Referring to Example 3, of Table 2, the magnetic cores of this example show a pulse permeability $\mu_I=5000$ at a pulse duration of 50μ seconds and an adjusted flux-densitiy change ΔB=1 T. A pulse duration of 20μ seconds yields a pulse permeability of over 4,000. Addition of molybdenum to the alloy as shown in Table 2, results in a maximum pulse permeability for a 50μ seconds pulse duration exceeding 8,000, while a pulse duration of 20μ seconds yields a pulse permeability of more than 6,000. By reduction of tape thickness it is possible to obtain an even greater increase in pulse permeability. Also evident is the fact that an increase in cooling results in improvement of the pulse permeability with only a slight decrease in the maximum available flux-density change.

The magnetic field treatment was carried out in such a way that about 20 tape-wound cores were arranged on a rod of non-magnetic material and after being tempered for ½ hours at 650° C. were drawn into the magnetic coil outside the furnace. The strength of the magnetic field extending axially to the tape-wound cores was H=800 A/cm.

The cooling rate was varied between 50° C./min. and 100° C./min. by blowing the tape-wound cores with compressed air at varying pressure. Slow cooling at 15° C./min. was achieved by embedding the tape-wound cores in alumina prior to the treatment. The cooling rate was measured in the temperature range, crucial for the magnetic field treatment, from 500° C. to 300° C. by a thermocouple arranged on the surface of the tape-wound cores.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for preparing a magnetic core for use with unipolar pulses and having a maximum available flux density change of more than 1 T and have a high pulse permeability, comprising the steps of:

(1) melting an iron-nickel alloy containing from 49 to 56 weight percent nickel;
(2) shaping said melted alloy;
(3) rolling said alloy into a thin tape having a maximum thickness of 0.1 mm;
(4) forming said tape to form a magnetic core;
(5) treating said core in a hydrogen atmosphere at a temperature above 1000° C. for about 3 to 6 hours;
(6) cooling said core to room temperature;
(7) reheating said core to above Curie Point temperature; and
(8) cooling said core in a magnetic field transverse to the direction of the magnetic flux obtained in application.

2. A process for preparing a magnetic core for use with unipolar pulses and having a maximum available flux density change of more than 1 T and having a high pulse permeability, comprising the steps of:

(1) melting an iron-nickel alloy containing from 49 to 56 weight percent nickel;
(2) shaping said melted alloy;
(3) rolling said alloy into a thin tape having a maximum thickness of 0.1 mm thickness;
(4) forming said tape to form a magnetic core;
(5) treating said core in a hydrogen atmosphere at a temperature exceeding 1000° C. for about 3 to 6 hours;
(6) immediately cooling said core to a temperature above Curie Point temperature; and
(7) further cooling said core in a magnetic field transverse to the direction of the magnetic flux obtained in application.

3. The process of claim 2 wherein said temperature above the Curie Point is 600°–750° C.

4. A process in accordance with claim 1, wherein the reheating is to a temperature of 650° C. to 750° C.

5. A process in accordance with claim 1, wherein the alloy contains up to 4 percent by weight or molybdenum.

6. A process in accordance with claim 1, wherein the magnetic field treatment is carried out with the aid of a coil through which a current flows.

7. A process in accordance with claim 1, wherein the magnetic field treatment is carried out outside of the furnace.

8. A process in accordance with claim 1 or 2, wherein the alloy contains silicon.

9. A process in accordance with claim 1 or 2, wherein the alloy contains manganese.

10. A process in accordance with claim 2, wherein the alloy contains up to 4 percent by weight of molybdenum.

11. A process in accordance with claim 2, wherein the magnetic field treatment is carried out with the aid of a coil through which a current flows.

12. A process in accordance with claim 2, wherein the magnetic field treatment is carried out outside of the furnace in a coil.

13. A process in accordance with claim 1 or 2 wherein the cooling in the transverse magentic field takes place at a rate of about 50° C. to about 100° C. per minute.

14. A process in accordance with claim 13 wherein the rate of cooling in the transverse magnetic field is applied over a temperature range of from about 500° C. to about 300° C.

15. A process in accordance with claim 1 or claim 2, wherein the cooling in the transverse magnetic field takes place at a rate of about 10° C. to about 100° C. per minute.

16. A process in accordance with claims 15, wherein the rate of cooling in the transverse magnetic field is applied over a temperature range of from about 500° C. to about 300° C.

* * * * *